US005210904A

United States Patent [19]

Pratt

[11] Patent Number: 5,210,904

[45] Date of Patent: May 18, 1993

[54] INTERENGAGING HANDLE ASSEMBLY

[75] Inventor: Michael J. Pratt, Park City, Utah

[73] Assignee: Ogio International, Inc., Salt Lake City, Utah

[21] Appl. No.: 739,818

[22] Filed: Aug. 2, 1991

[51] Int. Cl.[5] ..... B65D 25/28

[52] U.S. Cl. ..... 16/111 R; 16/125; 383/15

[58] Field of Search ..... 190/115, 116, 117, 118; 383/17, 15, 16, 20, 24, 6; 16/119, 125, 111 R

[56] References Cited

U.S. PATENT DOCUMENTS

| | | | |
|---|---|---|---|
| Re. 23,629 | 3/1953 | Henriksen | 150/12 |
| 1,359,461 | 11/1920 | Luce | 383/15 |
| 1,658,174 | 2/1928 | Russell | 190/117 |
| 2,488,309 | 11/1949 | Mason | 16/125 |
| 2,800,940 | 7/1957 | Riesebeck | 16/111 R |
| 3,115,228 | 12/1963 | Louik et al. | 190/117 |
| 3,115,229 | 12/1963 | Erhard | 190/57 |
| 3,486,684 | 12/1969 | Dills et al. | 229/54 |
| 3,737,945 | 6/1973 | Gould | 16/125 |
| 3,944,033 | 3/1976 | Simson | 190/57 |
| 4,316,629 | 2/1982 | Jacoby | 294/152 |
| 4,387,846 | 6/1983 | Ducorday | 383/15 |
| 4,592,091 | 5/1986 | Italici | 383/15 |
| 4,792,983 | 12/1988 | Allegre | 383/13 |

*Primary Examiner*—Lowell A. Larson

*Assistant Examiner*—Michael J. McKeon

*Attorney, Agent, or Firm*—Workman, Nydegger & Jensen

[57] ABSTRACT

This invention relates to an interengaging handle having a first handle member and a second handle member capable of interengagingly receiving the first handle member. A flexible connecting strap is attached to the handle members through longitudinal bores passing the length of the handle members. A connecting strap is passed through the longitudinal bore of the first handle member and is fixed in a position relative to the first handle member by forming a transverse hole through the first handle member that passes through the longitudinal bore and the connecting strap. A rivet is then placed in the transverse hole fixing the connecting strap in position. Stabilizer flanges may also be formed at or near the ends of the first handle member and the second handle member to orient forces directed along the connecting strap downward and outward away from the axis of the handle assembly. To enable the first handle member to be selectively locked in engagement with the second handle member, a locking tab is attached to the outer side surface of the first handle member capable of assuming an engaged position in a recess of the other handle member when the handle members are fully engaged.

10 Claims, 5 Drawing Sheets

INTERENGAGING HANDLE ASSEMBLY

BACKGROUND

1. Field of the Invention

This invention relates in general to handle constructions, and in particular, to a new and useful interlocking handle with two interengaging members for carrying suitcases, briefcases, gym bags and other portable articles utilizing flexible connecting straps.

2. Background Art

The background art is replete with portable articles of all shapes and sizes, ranging from simple paper bags without handles to sophisticated designer luggage. Most portable articles such as luggage and gym bags at least partially enclose a load to be carried and are usually provided with straps and/or hand grips for ease of carrying.

These straps and/or hand grips are often typically connected to the portable article. To be held in a single hand, these hand grip elements must be pulled together and must be maintained in that orientation by the grasp of the user. Users of portable articles utilizing such handles are subjected to the strain of maintaining the grasp necessary to keep the handles in a cooperating orientation in addition to bearing the weight of the loaded or often overloaded portable article.

Some handles have overcome the need to maintain the orientation of the handle elements with the grasp of the user by providing interengaging mechanisms that allow the handle elements to be temporarily joined after the portable article is loaded. Such a handle is illustrated in Jacoby, U.S. Pat. No. 4,316,629. The Jacoby handle utilizes engagement means to detachably connect the handle members in longitudinal juxtaposition. One problem associated with interengaging handles occurs as the elements of the handle are being engaged. Often, if the elements are not perfectly aligned, the elements will bind and refuse to engage properly. Improper engagement may result in an abrupt shift in the handle as proper engagement is later accomplished. This abrupt motion may cause the handle to slip from the grasp of a user or may cause the load to be spilled.

Most interengaging handles rely on the weight of a load to maintain engagement. While these handles function well for uninterrupted uses, they tend to become disengaged when the portable article is placed at rest upon a surface. Resumption of use requires reengaging the handle elements.

To overcome the problem of handle disengagement, some handles utilize adhesive strips or snaps to maintain the handle elements in their juxtaposed orientation. While adhesive strips alleviate the problems associated with handle element disengagement, adhesive strips do not function well in wet or dirty environments. Moisture, ice and dirt become trapped on the surfaces of adhesive systems such as Velcro®, thereby rendering the adhesive ineffective or inoperative. Likewise, snaps and other friction fastening systems fail to function well in many environments and, in addition, are hard to manipulate.

Another related problem associated with the use of flexible connecting straps is twisting or rolling the handle about the axis of the handle. This can result in difficulty in grasping the handle and/or can result in disengagement of the interengaging handle components.

Still another disadvantage of the currently available interengaging handle assemblies is the necessity of employing two hands to engage or disengage the handle members. This results in slower more cumbersome access to the portable articles.

OBJECTS AND BRIEF SUMMARY OF THE INVENTION

It is, therefore, one object of the present invention to provide a handle assembly which does not require the user to maintain the grasp necessary to keep handle elements together in a cooperating orientation.

It is a further object of the present invention to provide a handle assembly having handle elements that can be readily and securely engaged and disengaged in a wide variety of environments.

A still further object of the present invention is to provide a handle assembly having an aligning mechanism to ensure proper and quick assemblage of the handle elements with a minimum of manipulation.

Another object of the present invention is to provide a handle assembly which orients forces directed along the connecting straps away from the axis of the handle to discourage rolling of the handle in the hand of a user.

Yet another object of the present invention is to provide a handle assembly having a locking mechanism to ensure that the handle elements do not become inadvertently separated.

Still another object of the present invention is to provide a handle assembly which permits the quick and easy engagement and disengagement with minimum effort of the user for readily access or transportation of the intended article.

Yet another object of the present invention is to provide a handle assembly having means to initiate the separation of the interengaging handle member with the use of just one finger of one hand, thumb, permitting quick and convenient complete separation of the handle members with minimal effort.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims.

To achieve the foregoing objects, and in accordance with the invention as embodied and broadly described herein, an interengaging handle assembly is provided with two interengaging handle members. A first handle member has two side members, second handle member having a longitudinally disposed channel capable of cooperatively receiving the first handle member, connecting straps, and means for attaching the connecting straps to the first and second handle members.

Grooves in surface of one handle member and ridges on surface of the other handle member cooperate to align the handle members while the two are being engaged.

Stabilizer flanges are formed at or near the ends of at least one of the first or second handle members to orient forces directed along the connecting strap away from the axis of the handle so as to prevent or inhibit twisting or rolling of the handle assembly.

A reusable lock may also be provided to releasably secure the engagement of the first and second handle members. One presently preferred embodiment of the present invention utilizes means for the engagement of the handle members comprising an opening or recess formed in the surface of the second handle member into which a locking tab attached to the surface of the first handle member releasably passes during engagement. The locking tab may be released by pushing it out of the opening in the second handle member.

When the user wishes to unlock the handle members, the locking tab is biased to release the first handle member from locking engagement with the second member.

The handle assembly may also be provided with means for initiating disengagement of the first and second handle members when the locking tab is released from the opening or recess. One embodiment comprises a spring which is compressed when the two handle members are engaged. Upon releasing the locking tab, the spring moves the first handle member to assist in disengagement of the two handle members.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are therefore not to be considered limiting of its scope, the invention will be described with additional specificity and detail through the use of the accompanying drawings in which.

The present invention is directed to a handle assembly comprising a first handle means and a second handle member. The second handle member is configured to nestingly receive the first handle member. It is contemplated that the first handle member and the second handle member will be attached or otherwise affixed to a strap which is connected to the article to be carried.

DETAILED DESCRIPTION OF THE PREFERRED EMBODIMENTS

Figure 1:
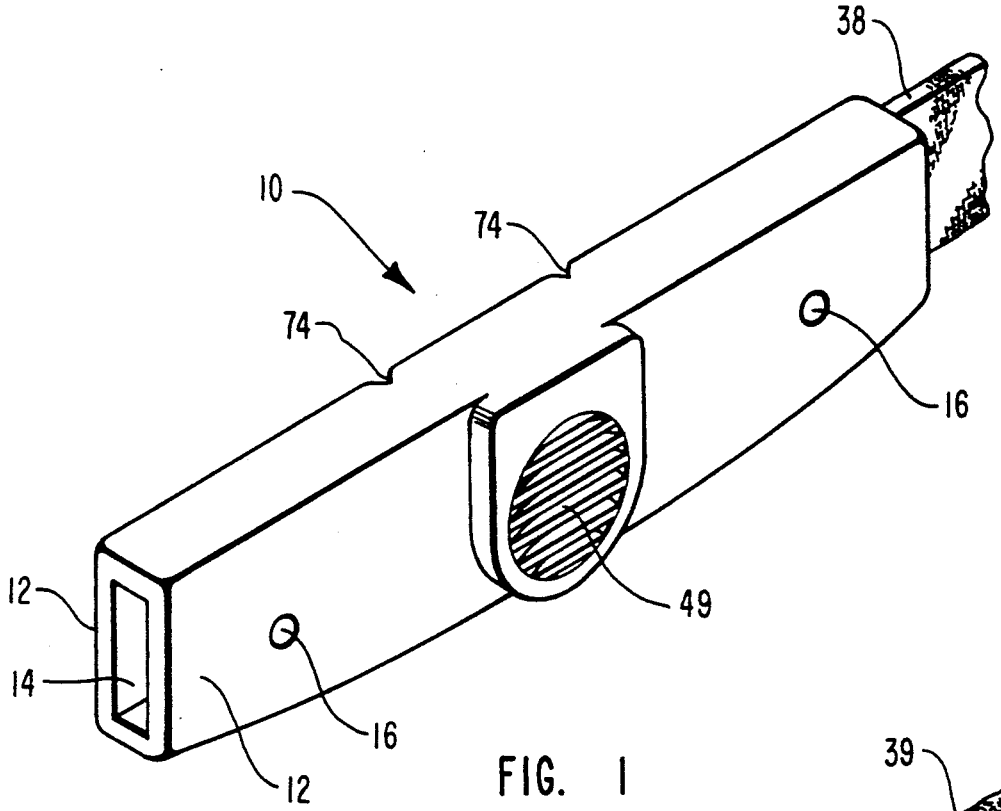
FIG. 1 is a perspective view of a first handle member made in accordance with the teachings of the present invention.

The present invention contemplates the interengaging of two handle members. FIG. 1 illustrates an embodiment of a first handle member 10. First handle member 10 has side members 12. First handle member 10 comprises means for attaching a connecting strap 38 to first handle member 10. By way of example and not limitation, means for attaching connecting strap 38 to first handle member 10 may comprise a longitudinal bore 14 passing through first handle member 10. In the presently preferred embodiment, longitudinal bore 14 passes through the longitudinal length of first handle member 10. Connecting strap 38 is passed through longitudinal bore 14 so that first handle member 10 may be used to carry the load born by strap 38.

If desired, and in order to ensure that first handle, member 10 remains positioned along strap 38 as desired, first handle member 10 may also comprises means for securing the position of the strap 38 relative to first handle member 10. By way of example and not limitation, the means for securing the relative position of strap 38 and handle member 10 comprises one or more rivets 16 or the like such that after strap 38 is passed through bore 14 and positioned as desired rivets or the like may fix the position of strap 38 in longitudinal bore 14 of first handle member 10. It may be necessary for rivets 16 to be flush with side members 12.

Because longitudinal bore 14 of handle member 10 is substantially along the axis of the overall handle assembly, and because strap 38 passes through longitudinal bore 14 and is attached to the portable article, the forces directed along strap 38 from the weight of the portable article, and hence along longitudinal bore 14, would be directed substantially along the axis of the handle assembly only. This orientation of forces would allow the axis of the handle assembly to be substantially coincident with the forces directed along strap 38. This may permit the handle assembly to roll in the hand of a user.

Figure 3:
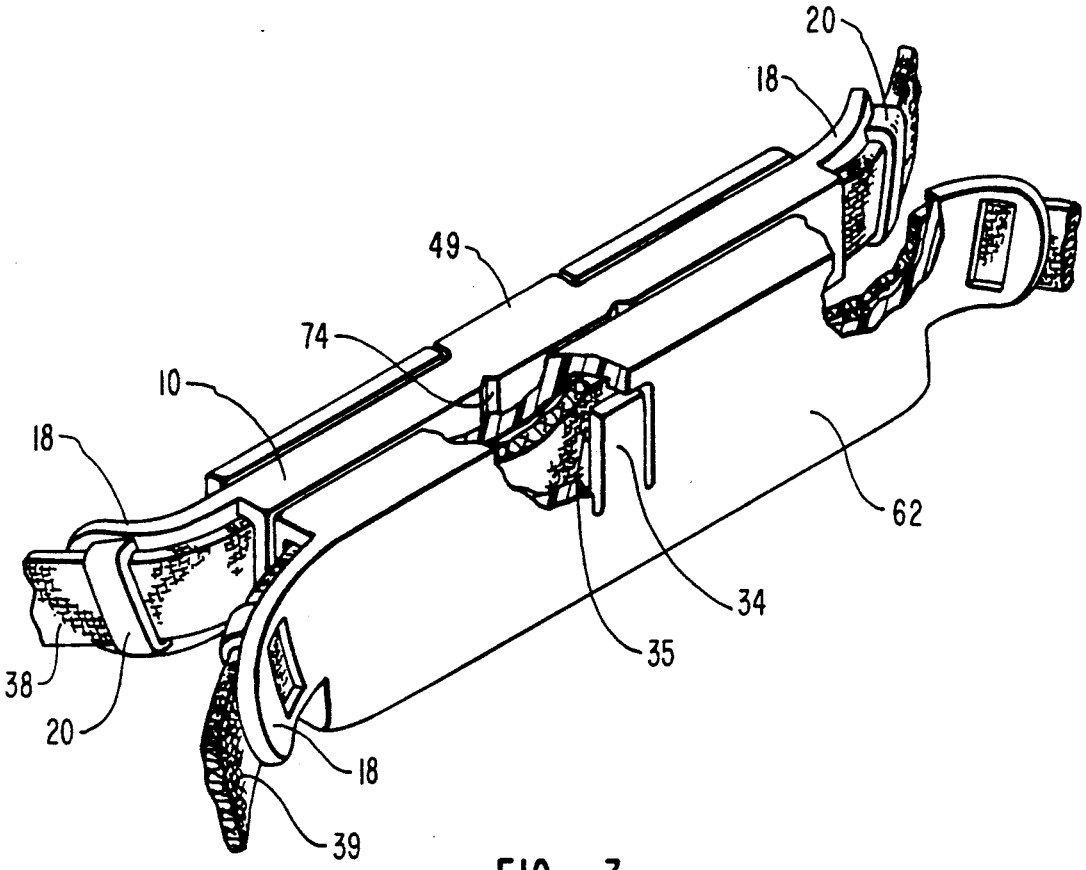
FIG. 3 is another partially broken-away perspective view of the handle illustrated in FIG. 1 also having stabilizer flanges.
Figure 4:
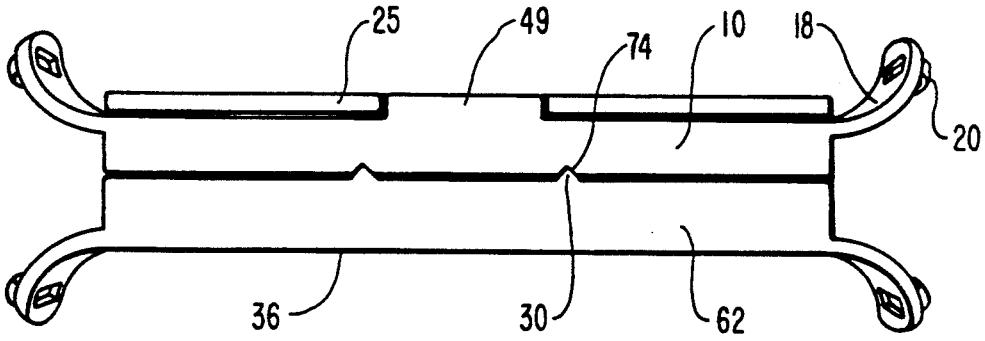
FIG. 4 is a plan view of the handle illustrated in FIG. 3.

As shown in FIGS. 3 and 4, the present invention may also comprise means for inhibiting or impeding any rolling or twisting of the handle assembly. By way of example and not limitation, the means for inhibiting any twisting or rolling of the handle assembly may comprise, for example, a stabilizer flange 18 formed at or near the end of first handle member 10. The stabilizer flange acts to direct forces acting along the strap 38 away from the axis of the handle assembly; this results in a stabilizing effect. A strap loop 20 may also be formed in stabilizer flange 18 to assist in the orientation of strap 38 to handle member 10. In the embodiment shown in FIG. 3, strap 38 is retained along the length of stabilizer flange 18 so as to route the forces directed along strap 38 downward and outward from first handle member 10.

It will be appreciated that the shape of stabilizer flange 18 may take many forms within the teachings of the present invention so long as the redirection of forces acting along strap 38 relative to the handle assembly produce a stabilizing effect upon the handle assembly. The presently preferred embodiment of the present invention utilizes stabilizer flanges that are helically arcuate, that is, flanges 18 act to redirect strap 38 both outward and downward from the handle assembly. The present invention also contemplates flanges that could be directed merely outward, or merely downward, not shown, or any other configuration so long as the configuration inhibits or impedes at least some twisting or rolling of the handle assembly.

Figure 2:
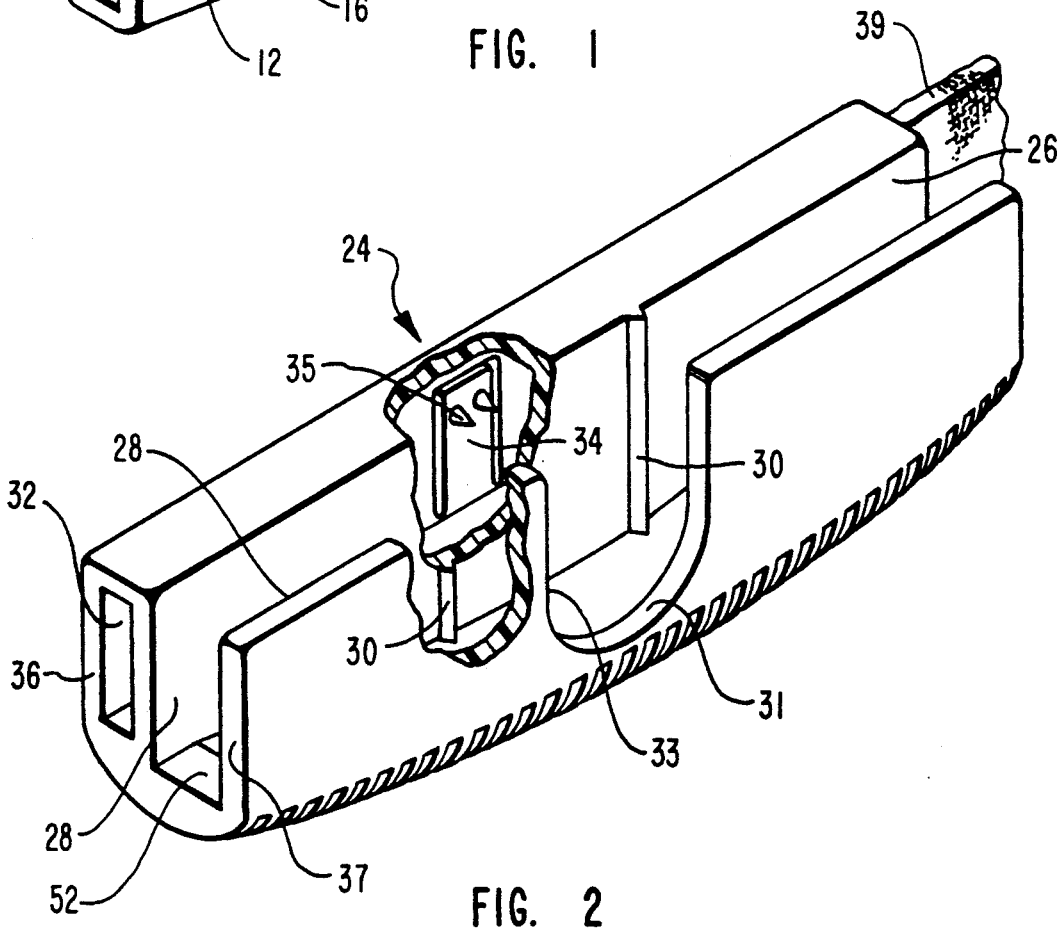
FIG. 2 is a perspective view of a second handle member made in accordance with the teachings of the present invention.

To better understand the function of first handle member 10 and its interaction with the other components of the present invention, FIG. 2 illustrates a second handle member 24 into which first handle member 10 is nested while carrying the portable article with the handle assembly. Second handle member 24 has a longitudinally disposed channel 26 for cooperatively receiving first handle member 10. Channel 26 has channel side surfaces 28 which are opposed to side members 12 of first handle member 10 when first handle member 10 and second handle member 24 are engaged.

To aid in the engagement of handle members, the present invention provides means for aligning first handle member 10 with second handle member 24 during engagement. By way of example and not limitation, the means for aligning first handle member 10 with second handle member 24 in the presently preferred embodiment of the present invention comprises an alignment element in one handle member and a mating alignment element in the other handle member. An alignment element illustrated in FIG. 2 is ridges 30. Ridges 30 are formed vertically on a side surface 28 of second handle member 24 and are capable of cooperating with corresponding grooves 74 in first handle member 10 (see FIGS. 1–2). The alignment elements cooperate to align first handle element 10 with second handle element 24 as first handle element 10 is being nested into channel 26 in second handle element 24. It is contemplated that the ridge elements of the alignment means may be equally effectively placed on first handle member 10 with mating grooves on second member 24.

Figure 9:
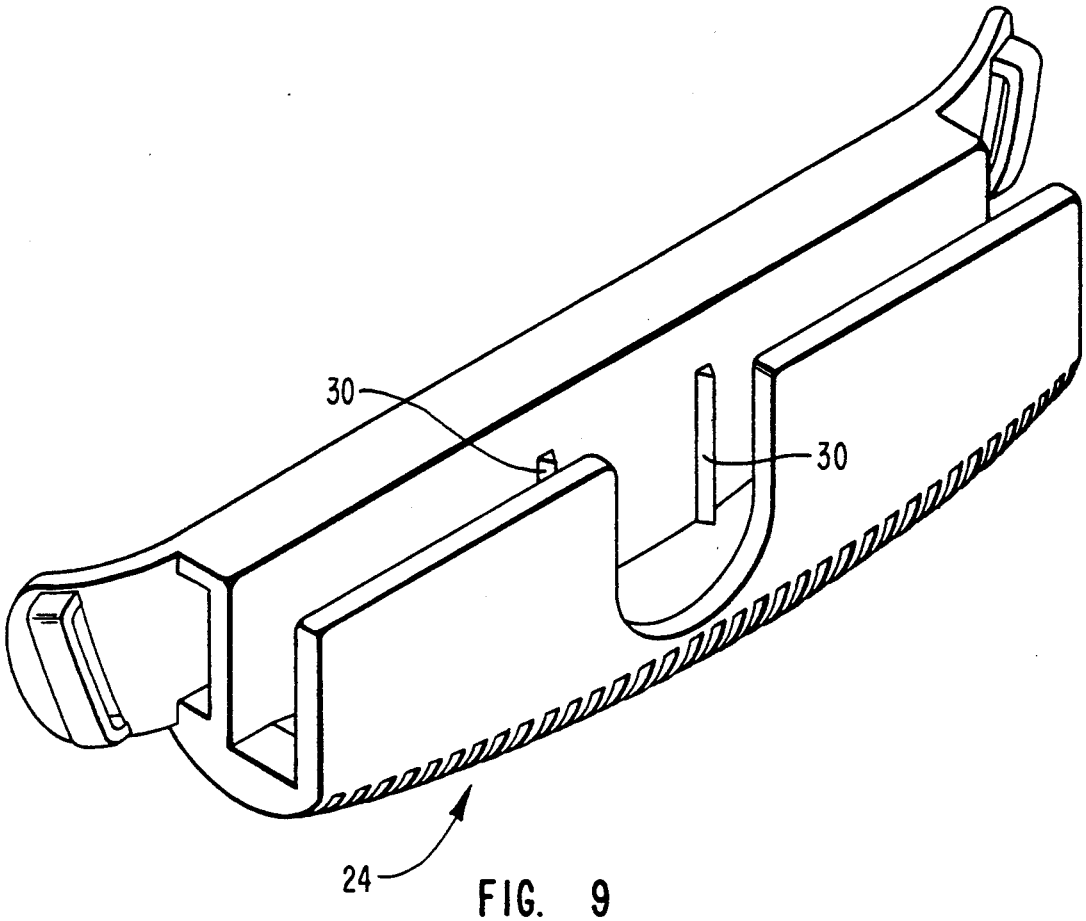
FIG. 9 illustrates an alternative keyway-ridge configuration.
Figure 10:
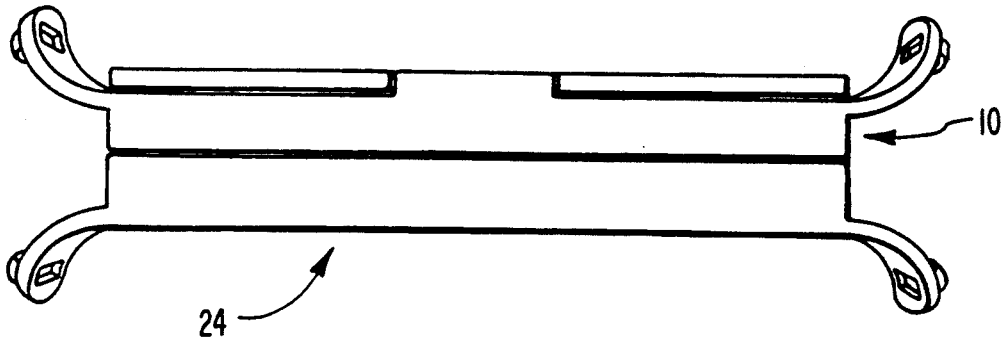
FIG. 10 is a plan view of the embodiment shown in FIG. 9.

It will also be appreciated that alignment elements may operate equally effectively even though the alignment elements do not traverse the entire vertical distance of the sidewalls as illustrated in FIGS. 1–8. As shown in FIG. 9, the alignment elements may terminate a distance from the vertical extreme of side members 12 and side members 28. In such an embodiment, the plan view would not evidence the concealed alignment element. See FIG. 10.

The present invention also provides means for attaching a strap 39 to second handle member 24. One embodiment of means for attaching strap 39 to second handle member 24 comprises a longitudinal bore 32 passing through second handle member 24 substantially parallel to side surfaces 28. Strap 39 is passed through longitudinal bore 32 and connected to the portable article.

It may be desired to secure strap 39 within longitudinal bore 32. One preferred embodiment of the present invention comprises means for securing the position of strap 39 in second handle member 24. One embodiment of the means for securing the position of strap 39 in second handle member 24 comprises a strap lock 34 formed in an exterior wall 36 of second handle member 24. Strap lock 34 is advantageously formed by removing a portion of exterior wall 36 and providing protrusions 35 which extend into longitudinal bore 32 as shown in FIG. 2. Protrusions 35 engage the connecting strap to fix its position in second handle member 24.

Strap lock 39 is also designed to be movable outward from exterior wall 36. This permits the selective disengaging of strap 39 by simply moving strap lock 24 outward from exterior wall 36, thus disengaging protrusions 35 from strap 39, repositioning the connecting strap if desired, and releasing strap lock 34 so it resumes its normal reposed position in which protrusions 35 engage strap 39 to secure the selective position of handle 24 to strap 39. See also FIG. 6. The means for securing the position of strap 39 in second handle member 24 is equally applicable to the positioning of strap 38 relative to first handle member 10 as a substitute to rivets 16 and vice-versa. For the purposes of this invention, the configuration of lock 34 and rivets 16 serve the same functional operation of strap lock.

While it is not necessary for the practice of the invention to provide stabilizer flanges on both handle member 10 and handle member 24, it may be beneficial to provide stabilizer flanges on both handle members, see FIGS. 3, 4, 5, 7, 9, and 10. While stabilizer flanges 18 are also incorporated into second handle member 24, they are similar in design and feature to flanges 18 discussed above in connection with first handle member 10.

While the preferred embodiments illustrated in the drawings depict handle member 10 and handle member 20 as substantially straight handle assembly elements, the present invention contemplates handle members that are curved or arched.

Similarly, while the preferred embodiments depict straps 38 and 39 coursing through bores 14 and 32, means for attaching strap 38 to first handle member 10 and means for attaching strap 39 to second handle member 24 alternatively contemplate merely attaching an end of strap 38 to strap 39 to the end of handle member 10 or handle member 24, respectively, and attaching another end of the straps to the portable article. In other words, it is not necessary for the straps to course through the handle members. So long as the advantageous features and functions of the present invention are utilized, the straps may be attached in any conventional manner as well.

The present invention also embraces a means for accessing first handle member 10 through a sidewall of second member 24 to permit manual manipulation of engagement of first handle member 10 within second handle member 24. One embodiment of the accessing means comprises an opening 33 in wall 37 defined by edgewall 31 of second handle member 24. The unique design of the present invention permits the user to physically manipulate handle member 10 while it is within channel 26 of second handle member 24 with minimal effort. Contact portion 49 is freely accessible through opening 33 defined by edgewall 31 in wall 37 of second member 24. As a result, the otherwise nested handle member 10 may be physically accessed through aperture 33 with quick convenience and ease. In this manner handle member 10 may be moved vertically in and out of handle member 24 by a simple and/or single thumb or finger force applied upon contact portion 49.

Figure 5:
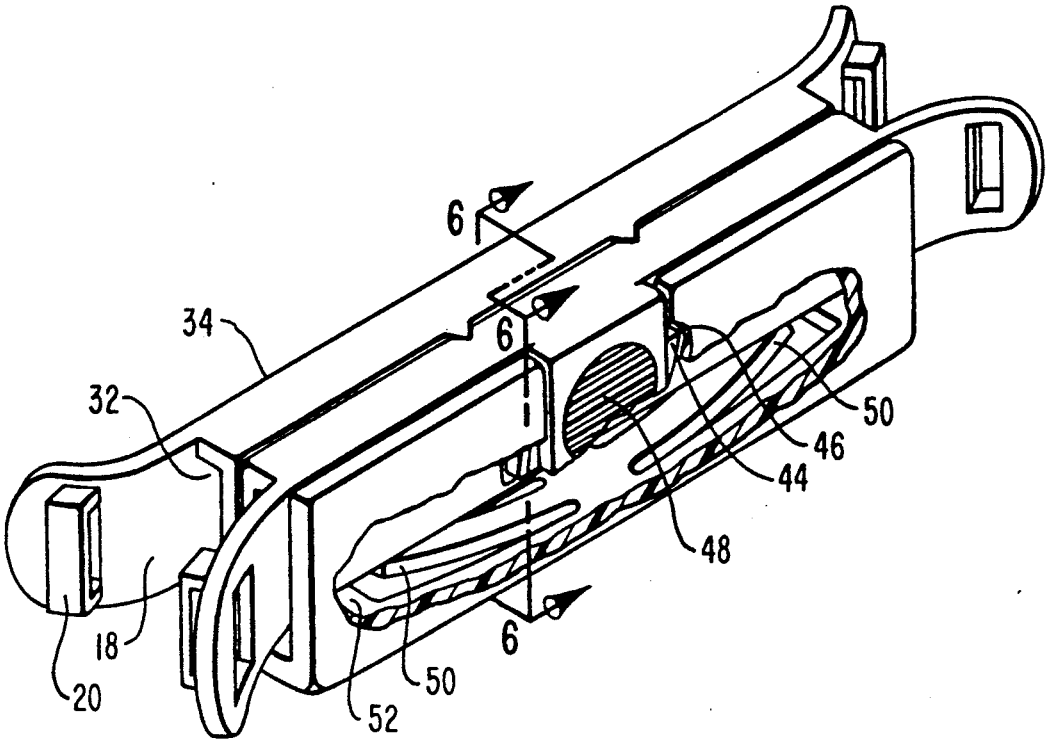
FIG. 5 is a partially cut-away view of another embodiment of the first and second handle members also having a locking mechanism.
Figure 6:
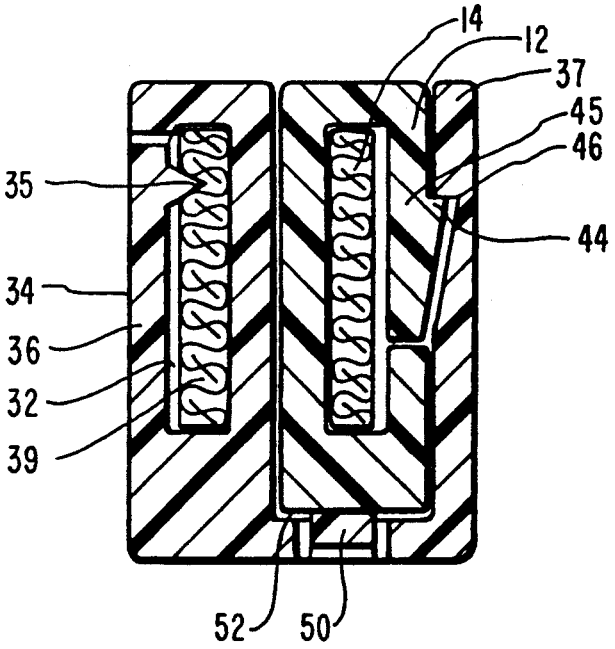
FIG. 6 is a cross-sectional view taken along lines 6—6 in FIG. 5.

The present invention may, if desired, also comprise means for releasably interlocking the handle member 10 with handle member 24. By way of example and not limitation, one presently preferred embodiment in FIGS. 5–6 illustrates means for releasably locking one of the handle members into engagement with the other handle member comprising locking ramp 44 formed in side member 12 of first handle member 10 and a recess 46 formed in side surface 28 of second handle member 24, and a release button 48 attached to locking ramp 44.

When first member 10 is being inserted into second member 24, locking ramp 44 causes ramp wall member 45 to move inward permitting ramp 44 to pass wall member 37 until ramp 44 reaches recess 46 into which ramp 44 enters. When a user wishes to separate first handle member 10 from second handle member 24, the user applies pressure inward on release button 48. Inward pressure on release button 48 moves locking ramp 44 inwardly, thereby separating locking ramp 44 from cooperative engagement with recess 46 to permit the release of first handle member 10 from locking engagement with second handle member 24. Release button 48 also serves the same function as contact portion 49 discussed in conjunction with FIG. 1.

The present invention also contemplates means for initiating disengagement of first handle member 10 from channel 26. The means for initiating disengagement of the present invention contemplates any spring or biasing configuration which encourages the disengagement of handle member 10 for handle member 24. By way of example limitation, the means for initiating disengagement of first member 10 out of channel 26 comprises a spring 50 on a floor 52 of channel 26. FIG. 5. Spring 50 is capable of moving first handle member 10 out of complete engagement with channel 26 in second handle member 24 in order to initiate a separation of the handle members when the handle members are released from locking engagement.

Spring 50 functions to bias first handle member 10 out of engagement with second handle member 24. The biasing force applied by spring 50 not only aids in separation of the handle members, but also provides pressure between locking ramp 44 and recess 46 when engaged in interlocking fashion. This pressure keeps the handle members in locking engagement until the user overcomes the frictional interface between locking ramp 44 and recess 46 by pressing release button 48 inward.

Figure 7:
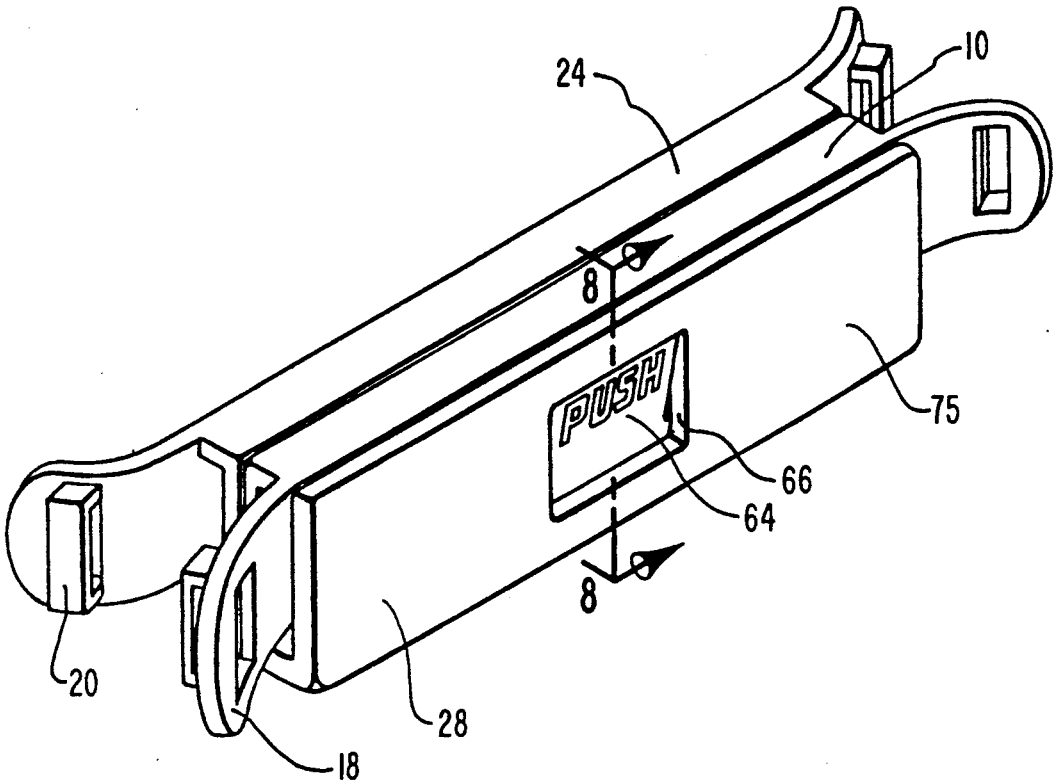
FIG. 7 is a perspective view of another embodiment utilizing the teachings of the present inventions.
Figure 8:
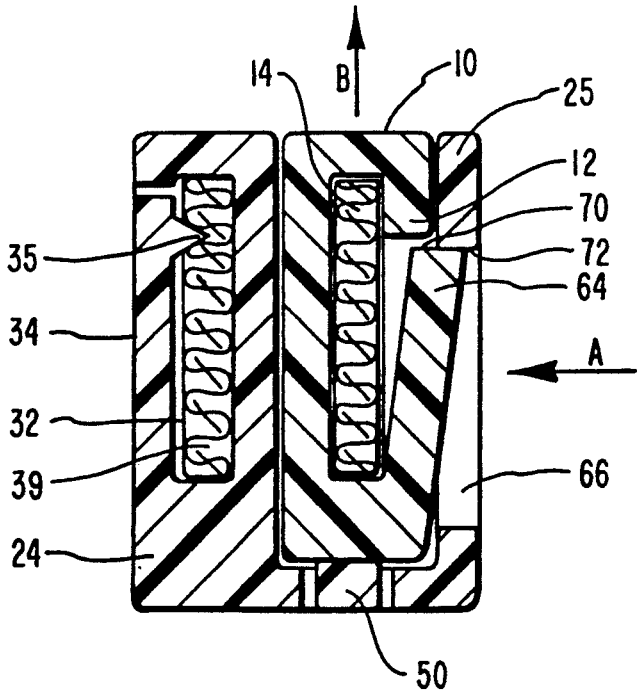
FIG. 8 is a cross-sectional view taken along lines 8—8 in FIG. 7.

FIGS. 7 and 8 illustrate another embodiment of the means for releasably locking first handle member 10 into engagement with second handle member 24. By way of example and not limitation, another means for releasably locking first handle member 10 into engagement with second handle member 24 comprises a locking tab 64 formed in side member 12 of first handle member 10, and a locking recess 66 formed in wall member 25 of second handle member 24. Tab 64 also comprises end 70. Locking tab 64 is capable of being inwardly shifted during engagement of first handle member 10 with second handle member 24. After engagement, locking tab 64 resumes its normal orientation and snaps into locking recess 66, thus forming a locking interface between end 70 of locking tab 64 and a surface 72 of recess 66. The frictional effect of the locking interface of end 70 and surface 72 may be augmented by upward biasing of a spring 50, as discussed above. When a user wishes to disengage first handle member 10 from second handle member 24, the user pushes tab 64 in the direction shown by arrow A thereby permitting end 70 to pass by wall member 25 in the direction shown by arrow B. If spring 50 is also incorporated into the assembly, disengagement of handle member 10 from handle member 24 is initiated when tab 64 is pushed in direction A far enough to permit end 70 to pass wall member 25 in direction B. Again, locking tab 64 may also serve the function of contact portion 49 discussed above.

FIGS. 5–8 illustrate the importance of and advantageous combination of the alignment means and locking means. If, as shown in FIGS. 5–7 the locking means is of discrete size and configuration, it is important to ensure that handle member 10 is properly aligned with handle member 24 so the cooperating locking elements function properly. The present invention contemplates that the handle members could nevertheless be locked in interengaging position without the necessity of the alignment mechanism. The alignment mechanism serves to greatly and conveniently simplify the interengaging operation. The present invention also contemplates locking distances than shown in the drawings. For example, the mechanism shown in FIGS. 7 and 8 could conceivably run substantially the entire length of the handle members.

Though not necessary for practicing the invention, interengagement is made easier by constructing the handle members of any sufficient rigid material having a low coefficient of friction so that the handle members may slide easily when the first handle member is being nested in the second handle member. It will be appreciated that one advantage to having handle members that are easily joined is that the present invention may be used in a variety of environments. Temperature and foreign particles do not impede the proper engagement of the handle members. Grooves and ridges on the handle members assist in the interengagement of the handle members with a minimum of dexterity. Users with poor motor coordination, young users or users with numb hands may all use the present invention with a minimum of effort. Some plastics could be suitable materials. Such materials must be sufficiently rigid so that second handle member 24 does not deform under load thereby reducing the integrity of channel 26 and the interengaging operation of the handle members.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Patent is:

1. An interengaging handle assembly comprising:

(a) a first handle member having two side members and a longitudinal bore passing through the first handle member, the longitudinal bore being configured so as to receive a flexible connecting strap;

(b) a second handle member having a longitudinally disposed channel for cooperatively receiving the first handle member, the longitudinally disposed channel having channel side surfaces for opposing the side members of the first handle member, and a longitudinal bore passing through the second handle member;

(c) flange means formed on the first handle member and the second handle member for stabilizing a flexible connecting strap;

(d) an alignment element in one handle member and a mating alignment element in the other handle member;

(e) a recess formed in the wall member of the second handle member;

(f) a locking tab attached to the side member of the first handle member, the locking tab being configured so as to assume an engaged position in the recess when the handle members are fully engaged.

2. An interengaging handle assembly connected by straps to an article, comprising:

(a) a first handle member having side members;

(b) a second handle member having a longitudinally disposed channel for cooperatively receiving the first handle member, the longitudinally disposed channel having channel side surfaces opposing the side members of the first handle member; and (c) means for releasably locking one of the handle members into engagement with the other handle member, wherein said means for releasably locking one of the handle members comprises:

(1) a recess formed in one of the handle members;

(2) a locking ramp affixed to the other opposing handle member corresponding in mating fashion to the locking recess wherein the recess is capable of recessing the locking ramp in an interengaging fashion; and (3) means for releasing the locking ramp from engagement association with the recess to separate one of the handle members from locking engagement with the other of the handle members.

3. An interengaging handle assembly connected by straps to an article, comprising:

(a) a first handle member having side members;

(b) a second handle member having a longitudinally disposed channel for cooperatively receiving the first handle member, the longitudinally disposed channel having channel side surfaces opposing the side members of the first handle member; and (c) means for releasably locking one of the handle members into engagement with the other handle member, wherein said means for releasably locking one of the handle members comprises:

(1) a recess formed in a wall member of the second handle member;

(2) a locking tab affixed to a side member of the first handle member, the locking tab being capable of being temporarily shifted from its outwardly extending repose position so as to be capable of assuming an engaged position within the recess when the handle members are fully engaged; and (3) means for selectively disengaging the locking tab from the opening to release the first handle member from locking engagement with the second handle member.

4. An interengaging handle assembly connected by straps of an article, comprising:

(a) a first handle member having side members;

(b) a second handle member having a longitudinally disposed channel for cooperatively receiving the first handle member, the longitudinally disposed channel having channel side surfaces opposing the side members of the first handle member;

(c) means for releasably locking one of the handle members into engagement with the other handle member; and (d) means for initiating the separation of the first handle member form the channel of the second handle member upon release of the locking means, wherein said means for initiating separation comprises a spring biasing the first handle in a direction out of engagement with the receiving channel in the second handle member to initiate the separation of the handle members when the handle members are released from locking engagement.

5. An interengaging handle assembly as recited in claims 2, 3 or 4, further comprising means for aligning the first handle member with the second handle member during engagement.

6. An interengaging handle assembly as recited in claim 5, wherein the means for aligning the first handle member with the second handle member comprises an alignment element in one handle member and a mating alignment element in the other handle member.

7. An interengaging handle assembly as recited in claim 6, wherein the alignment elements comprise grooves formed in a surface of one of the handle members and ridges formed on a surface of the other handle member.

8. An interengaging handle assembly as recited in claim 7 further comprising means for securing the relative position of at least one handle member relative to its connecting strap.

9. An interengaging handle assembly as recited in claims 2, 3 or 4, further comprising means for securing the relative position of at least one handle member relative to its connecting strap.

10. An interengaging handle assembly as recited in claim 9 wherein the means for securing the relative position of at least one handle member relative to its connecting strap comprises a strap lock disposed in a wall member of the handle member.

* * * * *

UNITED STATES PATENT AND TRADEMARK OFFICE

CERTIFICATE OF CORRECTION

PATENT NO. : 5,210,904

DATED : May 18, 1993

INVENTOR(S) : MICHAEL J. PRATT

It is certified that error appears in the above-indentified patent and that said Letters Patent is hereby corrected as shown below:

Column 2, line 30, "readily access" should be --ready access--
Column 4, line 10, delete second ","
Column 4, line 12, "comprises" should be --comprise--
Column 4, line 56, "arcuate, that is" should be --arcuate; that is,--
Column 6, line 2, "strap lock." should be --strap lock 34.--
Column 7, line 9, after "example" insert --and not--
Column 7, line 68, after "locking" insert --means which extend longitudinally along the handle in greater--

Signed and Sealed this

Twenty-second Day of March, 1994

Bruce Lehman

*Attest:*

BRUCE LEHMAN

*Attesting Officer*

*Commissioner of Patents and Trademarks*